US011530092B2

(12) United States Patent
Ross et al.

(10) Patent No.: US 11,530,092 B2
(45) Date of Patent: Dec. 20, 2022

(54) DUMPSTER

(71) Applicant: Southern Illinois Waste Container, LLC, Marion, IL (US)

(72) Inventors: Darrell Ross, Marion, IL (US); Mark Colombo, Marion, IL (US); Dax Mezo, Herrin, IL (US)

(73) Assignee: Southern Illinois Waste Container, LLC, Marion, IL (US)

( * ) Notice: Subject to any disclaimer, the term of this patent is extended or adjusted under 35 U.S.C. 154(b) by 34 days.

(21) Appl. No.: 16/924,344

(22) Filed: Jul. 9, 2020

(65) Prior Publication Data

US 2021/0016964 A1 Jan. 21, 2021

Related U.S. Application Data

(63) Continuation of application No. 29/698,164, filed on Jul. 15, 2019, now Pat. No. Des. 909,001.

(51) Int. Cl.

| | |
|---|---|
| ***B65F 1/12*** | (2006.01) |
| ***B65F 1/16*** | (2006.01) |
| *B65F 3/02* | (2006.01) |

(52) U.S. Cl.

CPC ..... *B65F 1/122* (2013.01); *B65F 1/16* (2013.01); *B65F 2003/023* (2013.01); *B65F 2003/0279* (2013.01)

(58) Field of Classification Search

CPC ..... B65F 1/122; B65F 1/16; B65F 2203/023; B65F 2203/0279

See application file for complete search history.

(56) References Cited

U.S. PATENT DOCUMENTS

| | | | | |
|---|---|---|---|---|
| D853,068 | S * | 7/2019 | Chen | D34/9 |
| 10,556,840 | B1 * | 2/2020 | Bradlee | C05F 17/989 |
| 2007/0034633 | A1 * | 2/2007 | Maggio | B65F 1/02 220/675 |
| 2018/0029793 | A1 * | 2/2018 | Harakal | B65F 1/141 |
| 2018/0134486 | A1 * | 5/2018 | Parker | B65F 1/1473 |
| 2020/0247609 | A1 * | 8/2020 | Maroney | B65F 3/02 |

OTHER PUBLICATIONS

United States Design U.S. Appl. No. 29/698,164, filed Jul. 15, 2019.

* cited by examiner

*Primary Examiner* — Saul Rodriguez
*Assistant Examiner* — Ashley K Romano
(74) *Attorney, Agent, or Firm* — James B. Conte; Craig R. Miles; CR Miles P.C.

(57) ABSTRACT

A dumpster for the collection and discharge of solid waste having one or more apertures covered by perforated panels disposed in the side walls or end walls to allow visual access to the interior compartment of the dumpster to allow visualization of the solid waste contained in the interior compartment and to identify any contaminant waste comixed with the solid waste.

4 Claims, 7 Drawing Sheets

DUMPSTER

This United States Non-Provisional patent application is a continuation of U.S. Design patent application No. 29/698,164, filed Jul. 15, 2019, hereby incorporated by reference herein.

I. FIELD OF THE INVENTION

A dumpster for the collection and discharge of solid waste having one or more apertures covered by perforated panels disposed in the sidewalls or end walls to allow visual access to the interior compartment of the dumpster to allow visualization of the solid waste contained in the interior compartment and to identify any contaminant waste comixed with the solid waste.

II. BACKGROUND OF THE INVENTION

The Environmental Protection Act (415 ILCS 5/1 et seq.) regulates the disposal of used tires and certain refuse in landfills. Each state further regulates the disposal of solid waste and my prohibit disposal of contaminate waste including as examples one or more of yard waste (grass, leaves, brush), lead acid batteries, white goods (refrigerators, ranges, water heaters, freezers, air conditioners, humidifiers and similar domestic and commercial appliances), used oil, or electronic products (computers, monitors, televisions, printers), and mercury controlled thermostats.

Additionally, each state may further regulate recycling waste streams and may require sorting of recyclable waste by type or into a single sort recycling waste stream. As one example, in 1988, the State of Illinois passed the Solid Waste and Recycling Act which mandates single-stream recycling in which consumers mix recyclables rather than sort them by type. After single-stream recyclables are picked up at the curb by a hauler or dropped-off at a collection site, the recyclables are transported to a material recovery facility where a series of sorting lines separate the items by type. Single stream recyclables include as examples: newspapers, magazines, cardboard, brown paper bags, aluminum cans, tin and steel cans, plastic milk containers, detergent and cleaning containers. The legislation and implementing regulations prohibit mixing contaminate waste into the single stream recyclables including for example: plastic bags, food waste, glass bottles, polystyrene cups, motor oil bottles, electronic devices, batteries, compact discs, garbage and yard waste. Recyclable waste concealed in a plastic bag may be prohibited. It is generally understood that for single-stream recycling to be effective, the contaminant waste in the single stream recyclable waste stream must be below five percent by weight and preferably below two percent by weight.

Additionally, animals and humans may be inside of the dumpster at the time of waste collection and may be injured by lifting and tilting of the dumpster and discharge into a waste collection vehicle.

Prohibited contaminate waste inadvertently discharged into the solid waste or recyclable waste contained in the waste collection vehicle may preclude the entire load of solid waste including the contaminant waste from being discharged into a land fill or the recycling facility. The contaminate waste, at substantial expense, may then have to be sorted from the solid waste or recyclable before discharge of the solid waste in the land fill or the recyclable waste at a recycling facility.

There would be a substantial advantage in a dumpster that allowed visual access to the interior compartment of the dumpster to identify contaminant waste and preclude or reduce contaminant waste in the solid waste contained in a waste collection vehicle.

III. SUMMARY OF THE INVENTION

Accordingly, a broad object of particular embodiments of the invention can be to provide a dumpster having one or more apertures communicating between the interior and the exterior surfaces of at least one of a pair of side walls or at least one of said pair of end walls of a dumpster which are covered by perforated panels allowing sufficient visual access to the solid waste or recyclable waste inside of the interior compartment of the dumpster from outside of the dumpster or from the waste collection vehicle to identify contaminant waste contained inside the dumpster.

Another broad object of particular embodiments of the invention can be to provide a method of making a dumpster having one or more apertures communicating between the interior and the exterior surfaces of at least one of a pair of side walls or at least one of said pair of end walls of a dumpster which are covered by a perforated panels allowing sufficient visual access to of the solid waste or recyclable waste inside of the interior compartment of the dumpster from outside of the dumpster or from the waste collection vehicle to identify contaminant waste contained inside the dumpster.

Another broad object of particular embodiments of the invention can be to provide a method of using a dumpster having one or more apertures communicating between the interior and the exterior surfaces of at least one of a pair side walls or at least one of said pair of end walls of a dumpster which are covered by a perforated panels including visualizing from outside of the dumpster, or from inside of the waste collection vehicle, the solid waste or recyclable waste inside of the interior compartment of the dumpster and further assessing through visualizing of the solid waste inside of the interior compartment of the dumpster whether the solid waste or recyclable waste includes contaminant waste and further including interdicting discharge of the solid waste or the recyclable waste including the contaminant waste into the waste collection vehicle.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 1:
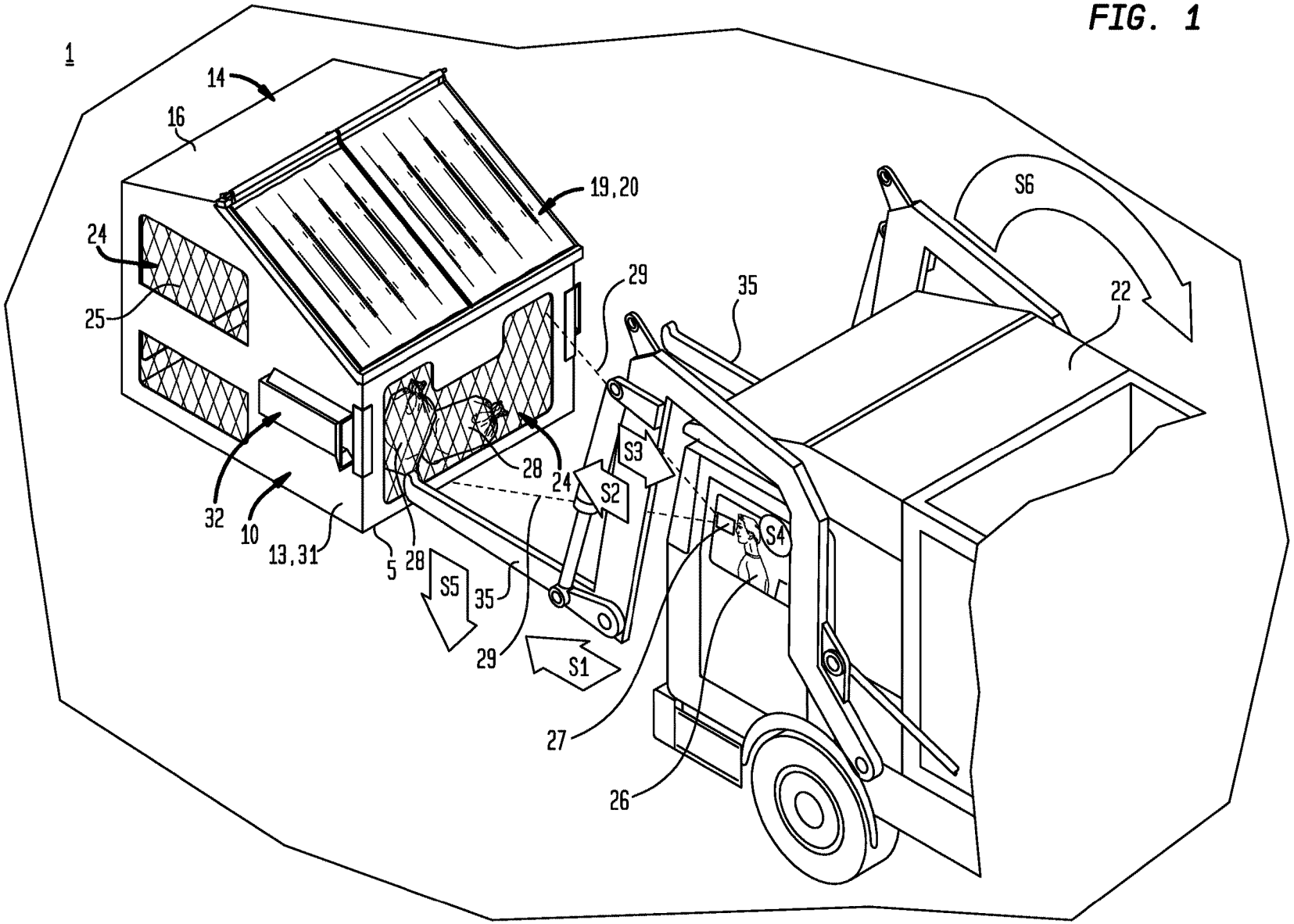
FIG. 1 is an illustration of a method of using an embodiment of the dumpster to collect and discharge waste.
Figure 2:
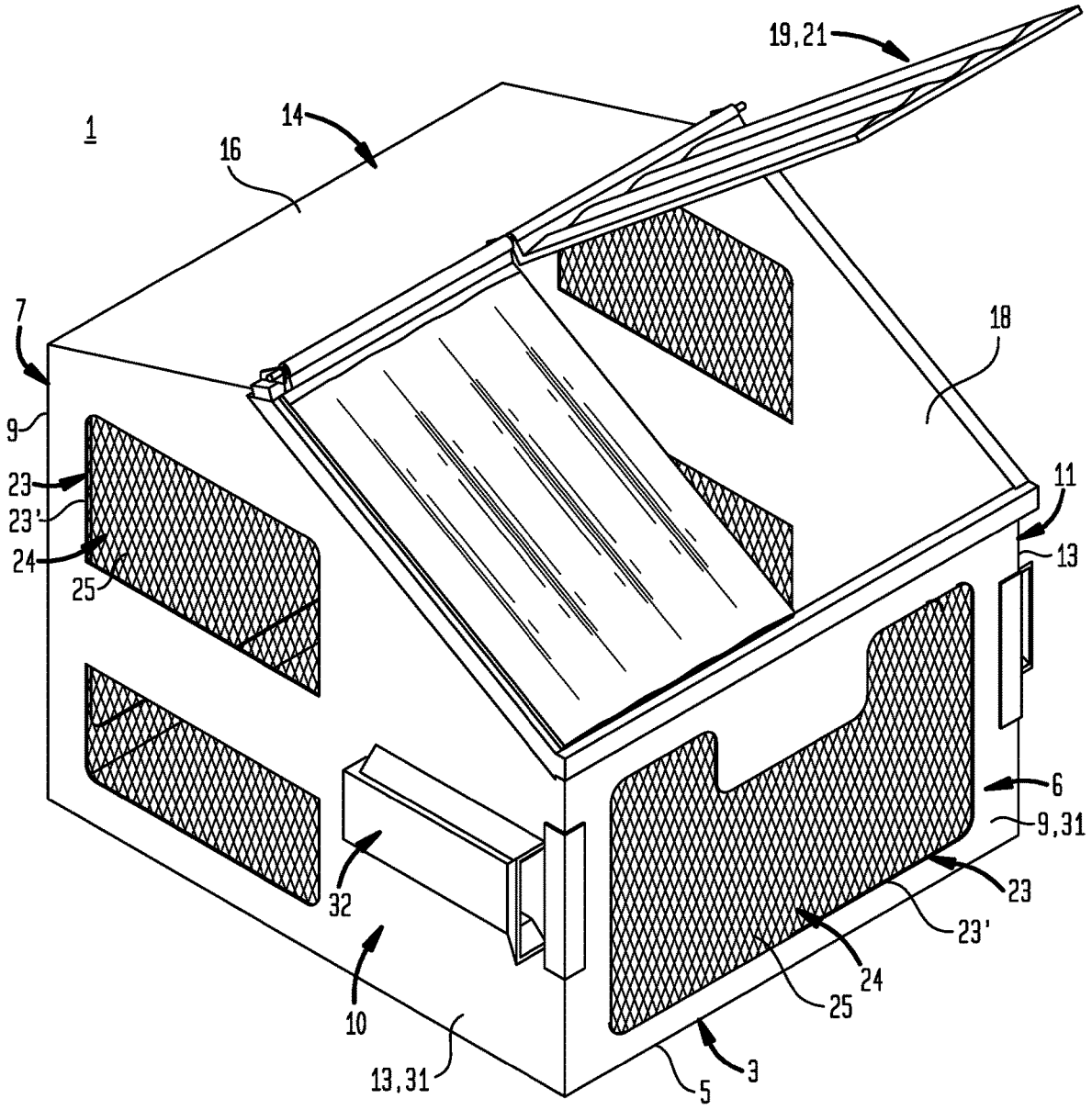
FIG. 2 is a perspective view of an embodiment of the dumpster.

Generally, with reference to FIGS. 1 through 9, which depict embodiments of an inventive dumpster (1) and methods of making and using the inventive dumpster to collect and discharge solid waste (2) comprising or consisting of one or more of: a floor panel (3) having floor panel interior and exterior surfaces (4)(5) and a pair of side walls (6)(7) having side wall interior and exterior surfaces (8)(9) which join to the floor panel (3) and a pair of end walls (10)(11) having end wall interior and exterior surfaces (12)(13) which join to the floor panel (3). The pair of side walls (6)(7) and the pair of end walls (10)(11) upwardly extending from the floor panel (3) to join a top panel (14) having top panel interior and exterior surfaces (15)(16). The interior surfaces (4)(8)(12)(15) of the floor panel (3), the pair of side walls (6)(7), the pair of end walls (10)(11) and the top panel (14) define an interior compartment (17) to contain solid waste (2) and a dumpster opening (18) through which to collect and discharge the solid waste (2) into and from the interior compartment (17) of the dumpster (1). One or more cover panels (19) can, but need not necessarily be, rotatably coupled in relation to the top panel (14), the side walls (6)(7) or the end walls (10)(11) to move between a cover closed condition (20) to cover the dumpster opening (18) and a cover open condition (21) to allow collection and discharge of solid waste (2) into and from the interior compartment (17) of the dumpster (1). Typically, embodiments of the dumpster (1) can, but need not necessarily have, a generally rectangular configuration which can be lifted by a waste collection vehicle (22) to discharge the solid waste (2) from the dumpster (1); and while FIG. 1 depicts a front loader waste collection vehicle (22), this is not intended to preclude embodiments which are lifted by a rear loader or a side loader waste collection vehicle (22). Typically, the interior compartment (17) of the dumpster (1) holds about three to about twenty cubic yards of solid waste (2); although the inventive features as shown and described can be used with dumpsters (1) having greater capacity.

Again, with general reference to FIGS. 1 through 9, one or more apertures (23) can communicate between the interior and exterior surfaces of at least one of the pair side walls (6)(7) or at least one of the pair of end walls (10)(11) of the dumpster (1). A perforated panel (24) can be disposed over the one or more apertures (23) to contain the solid waste (2) inside of the interior compartment (17). While the perforated panel (24) shown in the Figures affixes to the interior surfaces of the dumpster (1) to cover the one or more apertures (23) this is not intended to preclude embodiments in which the perforated panel (24) affixes to the exterior surfaces of the dumpster (1) or the aperture periphery (23'). Additionally, while the perforated panel (24) depicted in the Figures comprises an expanded sheet metal which has been cut and stretched to form a regular pattern of perforations; this in not intended to preclude embodiments which include other perforated materials such as diagonally crossed wire mesh screen, hardware cloth which can be differentiated by material, coating, wire diameter, or mesh size or perforated metal sheet stamped or punched to create a pattern of perforations such as circular holes or slots or other configurations. The one or more apertures (23) in the dumpster (1) covered by the perforated panel (24) can afford a sufficient perforated panel open area (25) between the exterior surfaces and the interior surfaces of the dumpster (1) to allow a person (26) inside of a waste collection vehicle (22)(as shown in the illustrative example of FIG. 1) visual access (29) to the solid waste (2) inside of the interior compartment (17) of the dumpster (1).

"Visual access" for the purposes of this invention means that a person (26) inside of the waste collection vehicle (22), or outside of the dumpster (1), can see into the interior compartment (17) of the dumpster (1), or see the solid waste (2) contained in the interior compartment (17) of the dumpster (1), either with or without the aid of a sight facilitating device (27) for example an optical device such as binoculars, telescope, glasses, magnifier, or camera; and in particular embodiments the person (26) can see the solid waste (2) with sufficient particularity to identify or distinguish contaminate waste (28) mixed within the solid waste (2) inside of the interior compartment (17) of the dumpster (1). Depending upon the definition of solid waste (2) and contaminate waste (28) in a particular jurisdiction, the one or more apertures (23) can have the dimensions and the location of the one or more apertures (23) in the pair side walls (6)(7) or the pair of end walls (10)(11) of the dumpster (1) adjusted and the perforated panel open area (25) further adjusted to allow visual access (29) of contaminate waste (28) inside the interior compartment (17) of the dumpster (1).

"Solid waste" for the purposes of this invention means solid waste stream which can be discharged into landfills or recyclable waste stream which can be discharged at a recycling facility of a particular jurisdiction in which the dumpster (1) resides.

"Contaminate waste" for the purposes of this invention means waste prohibited from being discharged in landfills or waste prohibited from being mixed into a recyclable waste stream of a particular jurisdiction in which the dumpster (1) resides. As illustrative examples, Environmental Protection Act (415 ILCS 5/1 et seq.) regulates the disposal of used tires and certain refuse. Illinois Public Act 85-11430 prohibits disposal of yard waste (grass, leaves, brush), lead acid batteries, white goods (refrigerators, ranges, water heaters, freezers, air conditioners, humidifiers and similar domestic and commercial appliances), used oil, or electronic products (computers, monitors, televisions, printers), and mercury controlled thermostats.

Accordingly, providing visual access (29) to the interior compartment (17) to identify contaminant waste (28) confers a substantial advantage in waste collection by avoiding mixing of contaminate waste (28) with disposable or recyclable solid waste (2) contained in the waste collection vehicle (22) which can contaminate the entire load of waste carried by the waste collection vehicle (22) and may prohibit the discharge of the entire load of waste at a landfill or recycling facility and may require manual sorting of the entire load of waste to remove contaminate waste (28) from dischargeable solid waste (2). In particular circumstances, visual access (29) can further avoid injury to persons or animals located in the interior compartment (17) of the dumpster (1).

Figure 3:
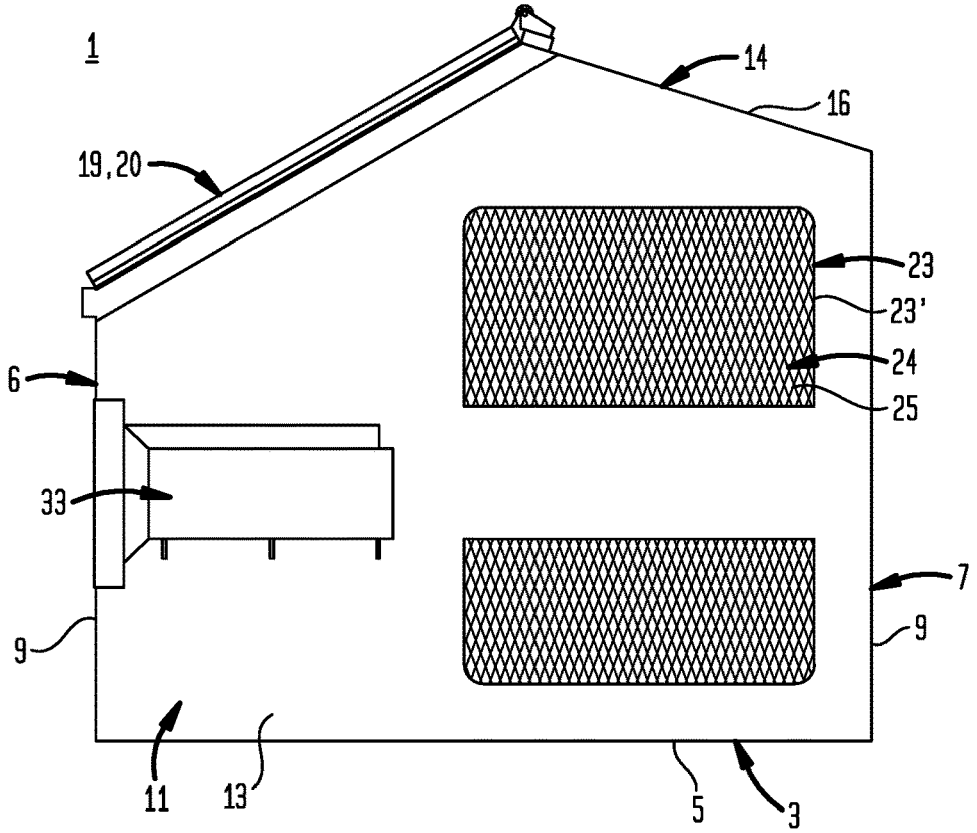
FIG. 3 is a first end elevation view of an embodiment of the dumpster.
Figure 4:
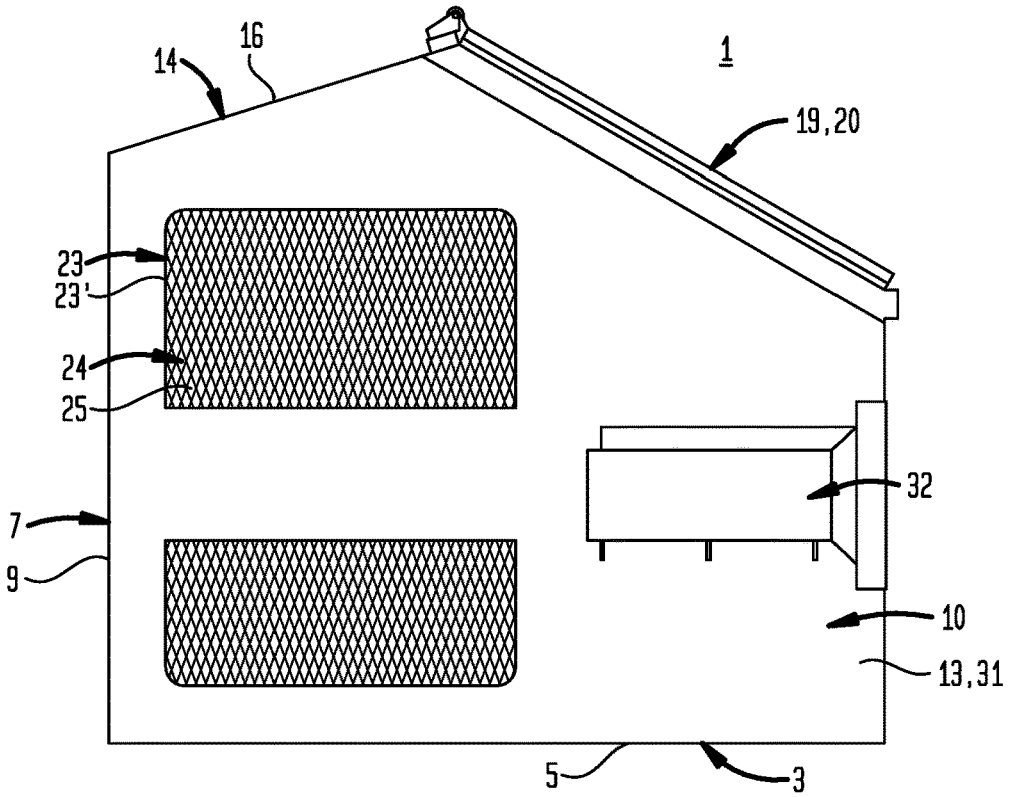
FIG. 4 is a second end elevation view of an embodiment of the dumpster.
Figure 6:
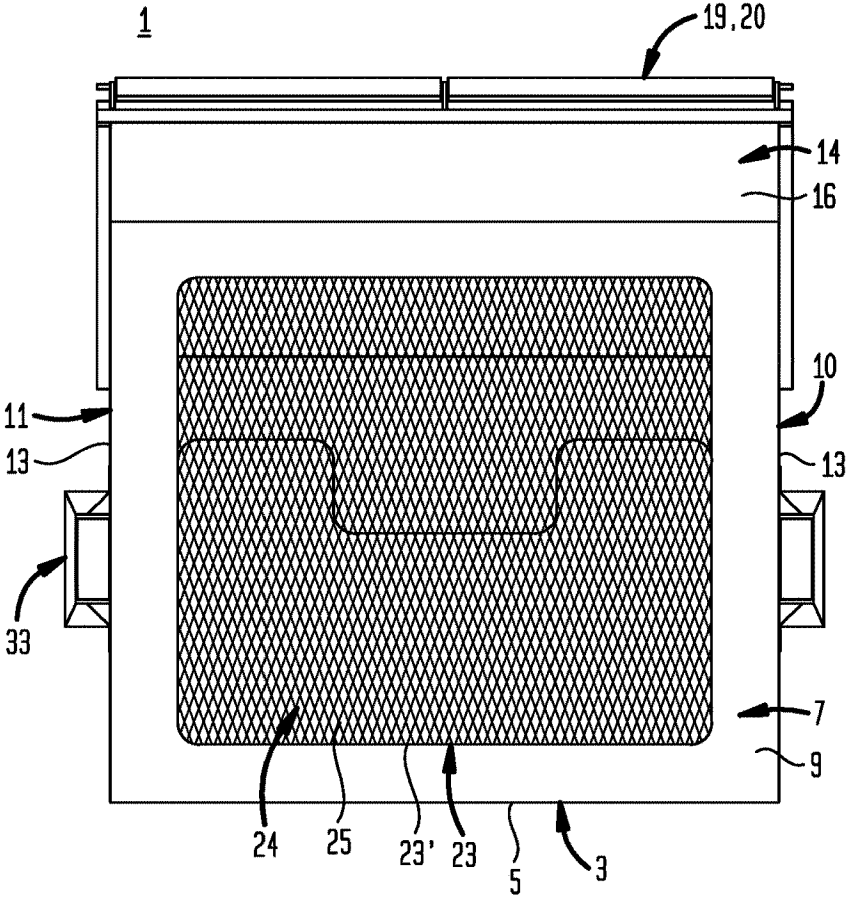
FIG. 6 is a second side elevation view of an embodiment of the dumpster.
Figure 5:
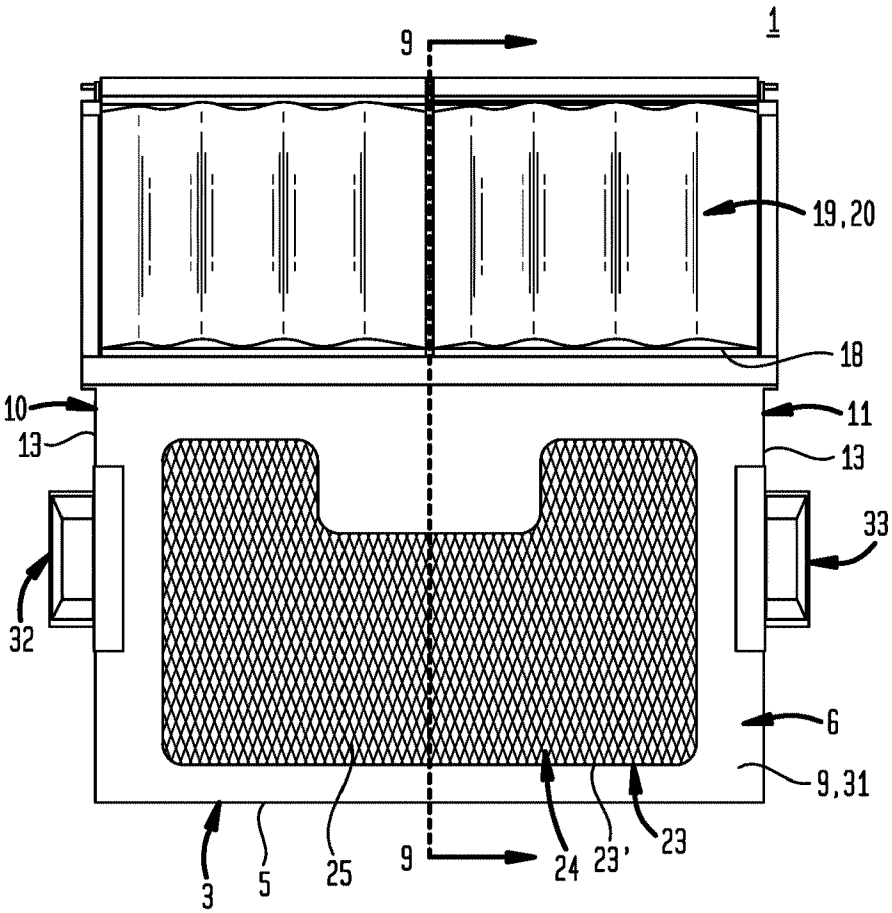
FIG. 5 is a first side elevation view of an embodiment of the dumpster.
Figure 7:
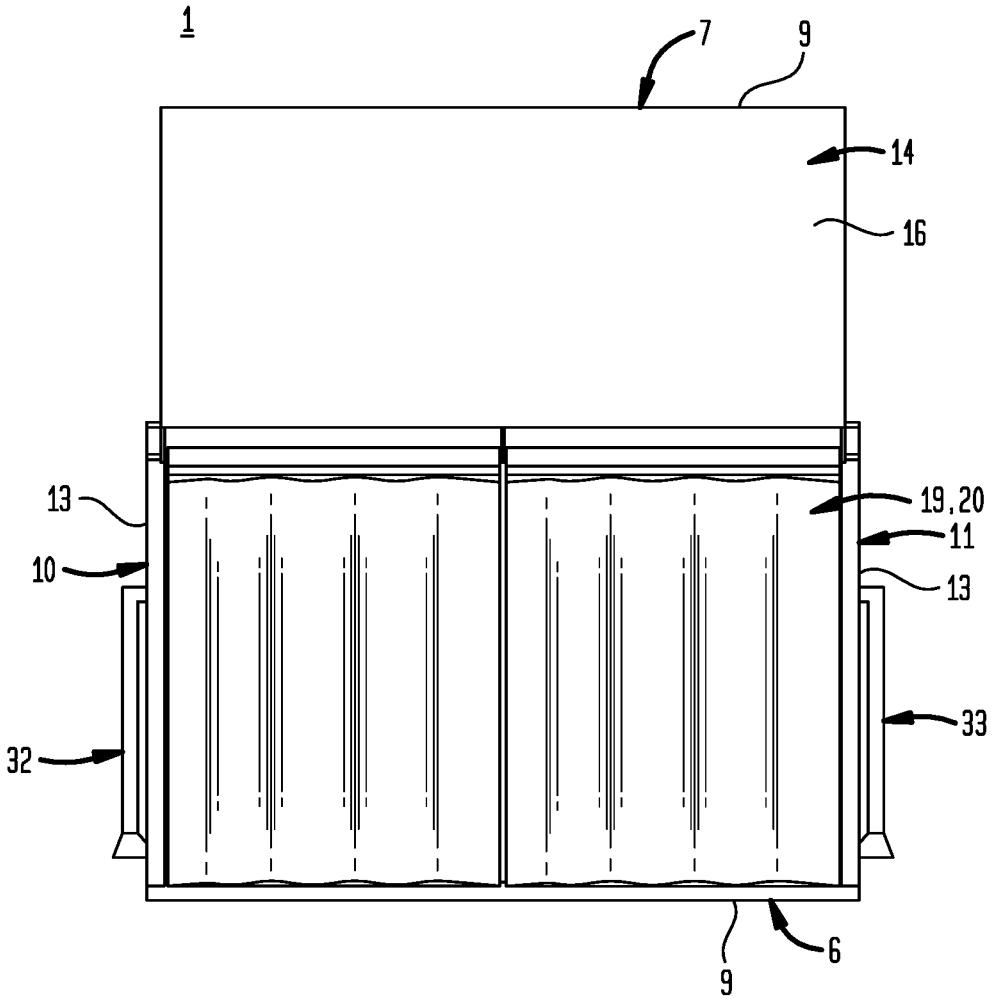
FIG. 7 is top plan view of an embodiment of the dumpster.
Figure 8:
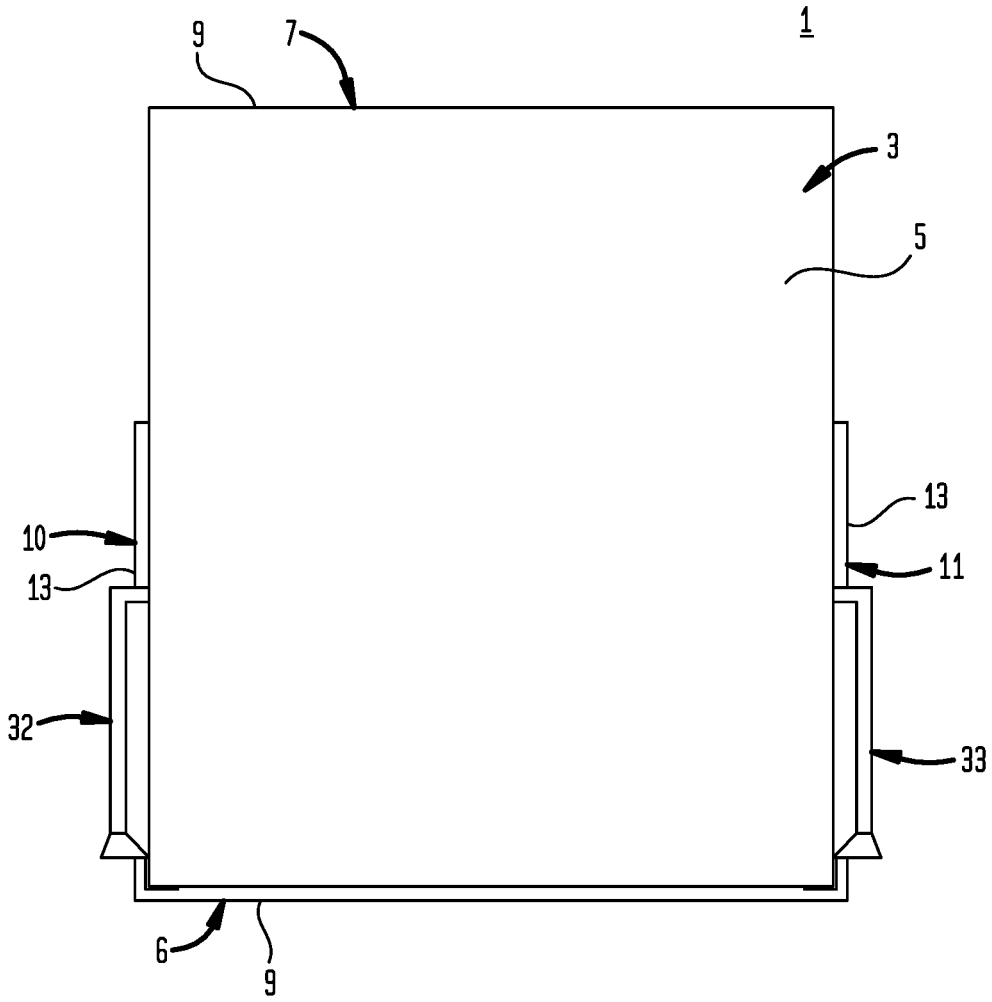
FIG. 8 is bottom plan view of an embodiment of the dumpster.
Figure 9:
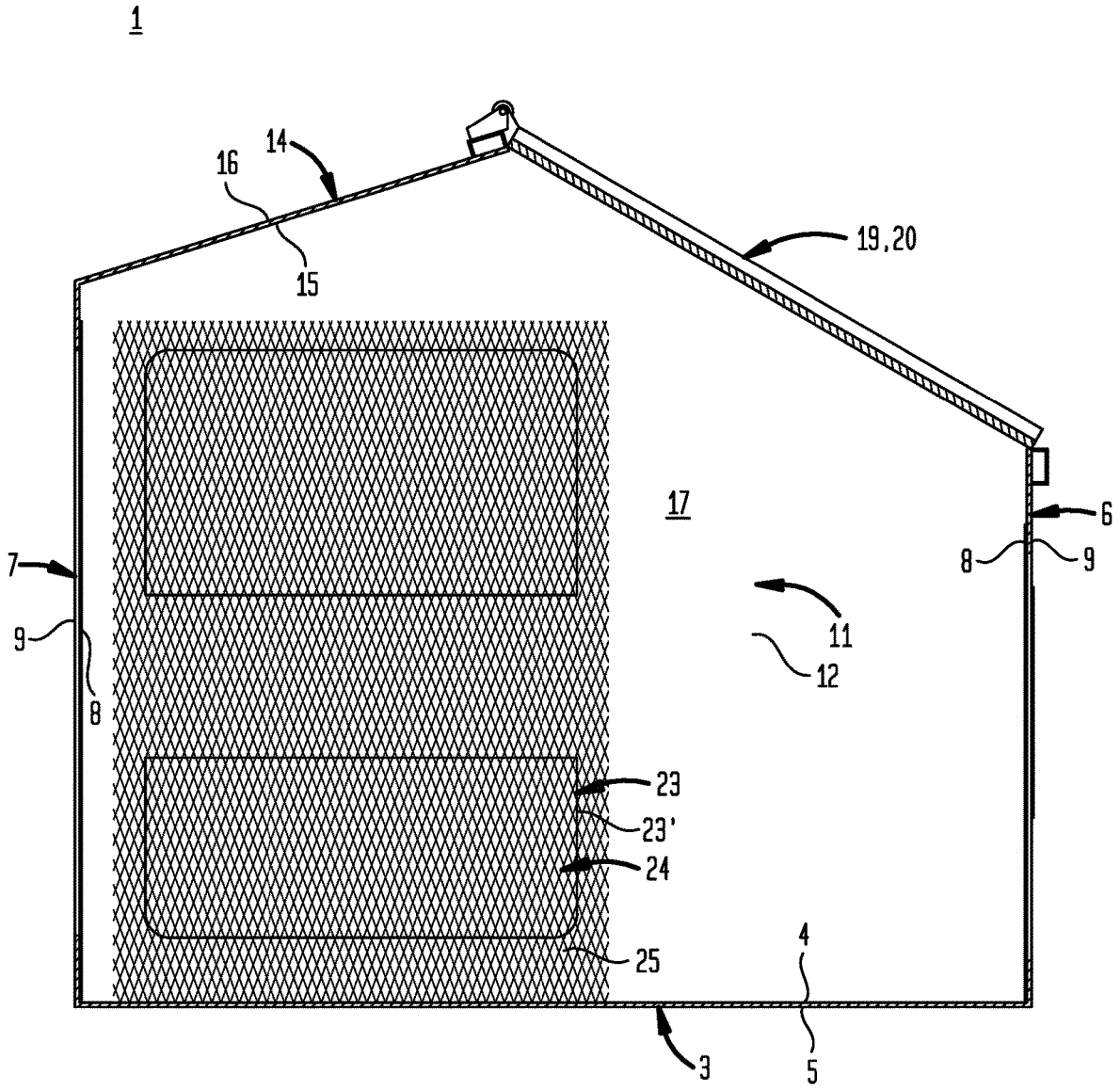
FIG. 9 is a cross section view 9-9 shown in FIG. 5 of an embodiment of the dumpster.

In particular embodiments, to provide visual access (29) one or more apertures (23) can be disposed in at least one of the pair side walls (6)(7) or at least one of the pair of end walls (10)(11); although as shown in the Figures each one of the pair of side walls (6)(7) and the pair of end walls (10)(11) can, but need not necessarily, include one or more apertures (23) covered by perforated panels (24) which allow visual access (29) to the interior chamber (17) of the dumpster (1), and embodiments can include apertures (23) in the top panel (14) or cover panels (19). In particular embodiments, as shown in the example of FIGS. 3 and 4, the apertures (23) in a particular one of the pair of side walls (6)(7) or the pair of end walls (10)(11) can comprise a plurality of apertures (23) and while two apertures (23A)(23B) are shown, this is not intended to preclude a greater number of apertures (23). In particular embodiments, the apertures (23) in one or both of the pair of side panels (6)(7) can be configured to coordinate with the apertures (23) in one or both of the pair of end panels (10)(11) to provide visual access (29) to entire height, length and width of the interior chamber (17). In particular embodiments, the apertures (23) can define a percentage open area (30) in relation to an exterior surface area (31) of the corresponding one of the pair side walls (6)(7) or the one of the pair of end walls (10)(11) occurring in the range of about 40 percent to about 90 percent, depending the structure of the dumpster (1), the coordination of the one or apertures (23) between the pair of side walls (6)(7) and the pair of end walls (10)(11), and the types of contaminant waste (28) to be identified in the interior chamber (17) of the dumpster (1).

Now, with primary reference to FIGS. 1 through 7, embodiments of the dumpster (1) can include a pair of sleeves (32)(33) one correspondingly mounted to the exterior surface (13) of the pair of end walls (10)(11) each of which have an elongate opening (34) adapted to receive lifting arms (35) of a solid waste collection vehicle (22) to permit the lifting arms (35) to lift and tilt the dumpster (1) to discharge the solid waste (2) from the interior compartment (17) of the dumpster (1) (as shown in the illustrative example of FIG. 1).

Now with primary reference to FIG. 1 and general reference to FIGS. 2 through 9, a method of using embodiments of the dumpster (1) above described can comprise or consist of one more of: positioning a solid waste collection vehicle (22) in relation to the dumpster (1)(S1) and visualizing from inside of the waste collection vehicle (22), or from outside of the dumpster (1), through the perforated panel open area (25) of the perforated panels (24) covering the apertures (23) disposed in one or more of the side walls (6)(7) or the end walls (10)(11) of the dumpster (1), the solid waste (2) contained inside of the interior compartment (17) of the dumpster (1)(S2). The method can further include assessing through visualizing of the solid waste (2) inside of the interior compartment (17) of the dumpster (1) whether the solid waste (2) includes contaminant waste (28)(S3). The method can further include determining through visualizing of the solid waste (2) inside of the interior compartment (17) of the dumpster (1) that the solid waste (2) includes contaminant waste (28)(S4) and interdicting discharge of the solid waste (2) including the contaminant waste (28) into the waste collection vehicle (22)(S5). The method can further include determining through visualizing of the solid waste (2) inside of the interior compartment (17) of said dumpster (1) that the solid waste (2) remains exclusive of contaminant waste (28) (does not include contaminant waste (28)) and engaging the lifting arms (35) of the waste collection vehicle (22) with the pair of sleeves (32)(33) of the dumpster (1) and lifting the dumpster (1) with the lifting arms (35) of the waste collection vehicle (22) to discharge the solid waste (2) from the interior compartment (17) of the dumpster (1) into the waste collection vehicle (22)(S6).

As can be easily understood from the foregoing, the basic concepts of the present invention may be embodied in a variety of ways. The invention involves numerous and varied embodiments of a dumpster (1) and methods for making and using such dumpster (1) including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "cover" should be understood to encompass disclosure of the act of "covering"—whether explicitly discussed or not—and, conversely, were there effectively disclosure of the act of "covering", such a disclosure should be understood to encompass disclosure of a "cover" and even a "means for covering." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the dumpsters herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A dumpster to collect and discharge solid waste, comprising:

a floor panel having interior and exterior surfaces;

a pair of side walls having interior and exterior surfaces, said pair of side walls joined to said floor;

a pair of end walls having interior and exterior surfaces, said pair of end walls joined to said floor, said pair of side walls and said pair of end walls upwardly extending from said floor;

a top panel joined to said pair of side walls or said pair of end walls;

said floor panel, said side walls, said end walls and said top panel defining an interior compartment to contain said solid waste and a compartment opening to collect and discharge said solid waste into and from said interior compartment;

one or more cover panels rotatably coupled to said top panel, said side walls or said end walls to cover said compartment opening;

a pair of sleeves correspondingly mounted to said exterior surface of said pair of side walls and having an elongate opening adapted to receive lifting arms of a solid waste collection vehicle to permit the lifting arms to lift and tilt the dumpster to discharge said solid waste from said interior compartment of said dumpster;

an aperture communicating between said interior and exterior surfaces of at least one of said pair of side walls or at least one of said pair of end walls; and a perforated panel disposed over said aperture to contain said solid waste inside of said interior compartment, said perforated panel allowing visual access of said solid waste inside of said interior compartment from outside of said dumpster or from within said waste collection vehicle; and wherein said aperture in said at least one of said pair side walls or said at least one of said pair of end walls defines a percentage open area in relation to an exterior surface area of said at least one of said pair of side walls or said at least one of said pair of end walls in the range of between about 40 percent to about 90 percent.

2. The dumpster of claim 1, wherein said aperture comprises a plurality of apertures in said at least one of said pair of side walls or said at least one of said pair of end walls, said plurality of apertures in said at least one of said pair of side walls or said at least one of said pair of end walls defines a percentage open area in relation to an exterior surface area of said at least one of said pair of side walls or said at least one of said pair of end walls in the range of between about 40 percent to about 90 percent.

3. A method of making dumpster to collect and discharge solid waste, comprising:

joining a pair of side walls having interior and exterior surfaces to a floor panel;

joining a pair of end walls having interior and exterior surfaces to said floor, said pair of side walls and said pair of end walls upwardly extending from said floor;

a top panel joined to said pair of side walls or said pair of end walls;

said floor panel, said side walls, said end walls and said top panel defining an interior compartment to contain said solid waste and a compartment opening to collect and discharge said solid waste into and from said interior compartment;

rotatably coupling one or more cover panels to said top panel, said side walls or said end walls to cover said compartment opening;

mounting one of a pair of sleeves to said exterior surface of said pair of side walls, said pair of sleeves each having an elongate opening adapted to receive lifting arms of a solid waste collection vehicle to permit the lifting arms to lift and tilt the dumpster to discharge said solid waste from said interior compartment of said dumpster;

disposing an aperture in at least one of said pair of side walls or at least one of said pair of end walls; and disposing a perforated panel over said aperture to contain said solid waste inside of said interior compartment, said perforated panel allowing visual access of said solid waste inside of said interior compartment from said waste collection vehicle; and wherein said aperture in said at least one of said pair of side walls or said at least one of said pair of end walls defines a percentage open area in relation to an exterior surface area of said at least one of said pair of side walls or said at least one of said pair of end walls in the range of between about 40 percent to about 90 percent.

4. The method of claim 3, wherein said aperture comprises a plurality of apertures in said at least one of said pair of side walls or said at least one of said pair of end walls, said plurality of apertures in said at least one of said pair of side walls or said at least one of said pair of end walls defines a percentage open area in relation to an exterior surface area of said at least one of said pair of side walls or said at least one of said pair of end walls in the range of between about 40 percent to about 90 percent.

* * * * *